United States Patent [19]

Ahlrich

[11] 4,155,348

[45] May 22, 1979

[54] VENTILATING APPARATUS

[76] Inventor: Willard K. Ahlrich, 2227 Pine Lake Dr. NW., Stuart, Fla. 33494

[21] Appl. No.: 840,654

[22] Filed: Oct. 11, 1977

[51] Int. Cl.[2] ..... F21C 15/08; F23J 11/00

[52] U.S. Cl. ..... 126/299 D; 55/DIG. 36

[58] Field of Search ..... 98/115 R; 126/299 D; 55/DIG. 36

[56] References Cited

U.S. PATENT DOCUMENTS

| | | | |
|---|---|---|---|
| 2,535,863 | 12/1950 | Pledger | 126/299 D |
| 2,868,108 | 1/1959 | Peterson | 126/299 D |
| 3,318,227 | 5/1967 | Nelson et al. | 98/115 LH |
| 3,785,124 | 1/1974 | Gaylord | 55/DIG. 36 |

*Primary Examiner*—Ronald C. Capossela
*Attorney, Agent, or Firm*—Blanchard, Flynn, Thiel, Boutell & Tanis

[57] ABSTRACT

A ventilator for cooking units particularly of the kind having a forwardly disposed cooking area and a rearwardly disposed, upstanding flue, as for exhausting of combustion products. The ventilator comprises a free-standing floor-supported hood of rectangular box shape and opens forward and downward to receive the cooking unit removably therein. The hood is formed by boxlike inner and outer shells opening forwardly and downwardly with their top, back and opposite side panels spaced to define a single continuous air flow space therebetween. The air flow space is closed except for an inlet adjacent the rear of the hood and an outlet comprising an inverted U-shaped slot disposed near and extending along the front edges of the top and side panels of the inner shell to face into the cooking area and having a pair of flow directing louvers extending therealong. A U-shaped perforated baffle between the shells separates the front and rear parts of the air space. An exhaust stack communicates with the upper rear portion of the inner shell. A substantially J-shape member extending the width of the inner shell below the exhaust stack on the one hand supports filters facing down and forward toward the cooking area for removing cooking fumes therefrom, and on the other hand, is spaced by a downwardly flaring bypass or slot from the rear panel of the inner shell to deflect exhaust flow from the cooking unit flue, positioned immediately therebeneath, to the exhaust stack without going through the filter.

6 Claims, 4 Drawing Figures

VENTILATING APPARATUS

FIELD OF THE INVENTION

This invention relates to a ventilator for cooking units, and more particularly to a free-standing floor-supported hood for independently floor-supported cooking units, particularly cooking units having a forwardly disposed cooking area and a rearwardly disposed, upstanding flue.

BACKGROUND OF THE INVENTION

Typical restaurant type cooking unit ventilators have in the past been custom-built and installed by securement to supporting wall or ceiling surfaces of the restaurant kitchen and/or by securement to the cooking unit itself, which makes the installation relatively time consuming and expensive, and may interfere with access to portions of the cooking unit for maintenance or other purposes. Need for connection to the wall or ceiling of the building to support the ventilator also reduces flexibility in determining where to initially install the ventilating unit, as well as reducing flexibility in future relocating of the ventilator, should such be desired. On the other hand, support of the ventilator on the cooking unit itself interferes with removal and replacement of defective cooking units and use of the ventilator with cooking units for which it was not specifically designed.

An attempt has been made to overcome these difficulties in prior restaurant cooking unit ventilator units, by providing the ventilator as an integral unit in itself, which can stand by itself on the floor of the kitchen and which requires no support (excepting air and gas flow ducting) from the walls or ceiling of the kitchen or from the cooking unit, as in the ventilator disclosed in Peterson U.S. Pat. No. 2,868,108. However, even in the structure disclosed in such patent, it is suggested that the hood be secured to the cooking unit. Moreover, problems of insulation of the hot cooking units from areas to the side and back thereof, and substantially complete gathering of exhaust and cooking fumes from the cooking units, are not entirely and satisfactorily solved by floor-supported ventilating units of known type. Thus, however, such floor supported, independent ventilators, of which I am aware, have been less than completely satisfactory for several reasons.

Accordingly, the objects and purposes of this invention include provision of:

A floor-supported, independent ventilator for cooking units, which requires no attachment to the wall or ceiling of the kitchen nor to the cooking unit or units received therein.

A ventilator, as aforesaid, including stack connections for exhausting air and vapors generated by the cooking unit and clean air inlet stack means for supplying fresh air to the cooking area.

A ventilator, as aforesaid, of hoodlike form having a continuous open air space at the top, back and sides to assist in insulating nearby objects from heat generated by the cooking unit and wherein such insulating effect is further assisted by circulation of air from the fresh air inlet through such top, back and sides, and wherein the same circulation of air is guided through the hollow top and side walls of the hood toward the cooking area of the cooking unit to sweep cooking vapors positively toward the exhaust stack for removal from the kitchen.

A ventilator, as aforesaid, particularly adapted to use with cooking units, such as deep fat fryers, etc., having forwardly disposed cooking areas and rearwardly disposed, upstanding exhaust flues for combustion products or the like, and wherein the ventilator without attachment to the cooking unit maintains separation of the flue gases from the cooking area gases for a sufficient length of their travel through the exhaust portion of the ventilator as to permit filtering of only the cooking area gases while permitting a control of flow rate of the flue gases.

A ventilator, as aforesaid, in which the passage of incoming air through the hollow top and side walls is controlled for enhanced uniformity of air flow of the forward portion of the top and side walls toward the cooking area, and wherein such air flow control within such hollow walls assists in rigidifying the ventilator structure.

A ventilator, as aforesaid, which is simple in structure and readily constructed, and which is readily and rapidly installable.

Other objects and purposes of the invention will be apparent to persons acquainted with apparatus of this general type upon reading the following specification and inspecting the accompanying drawings.

Figure 1:
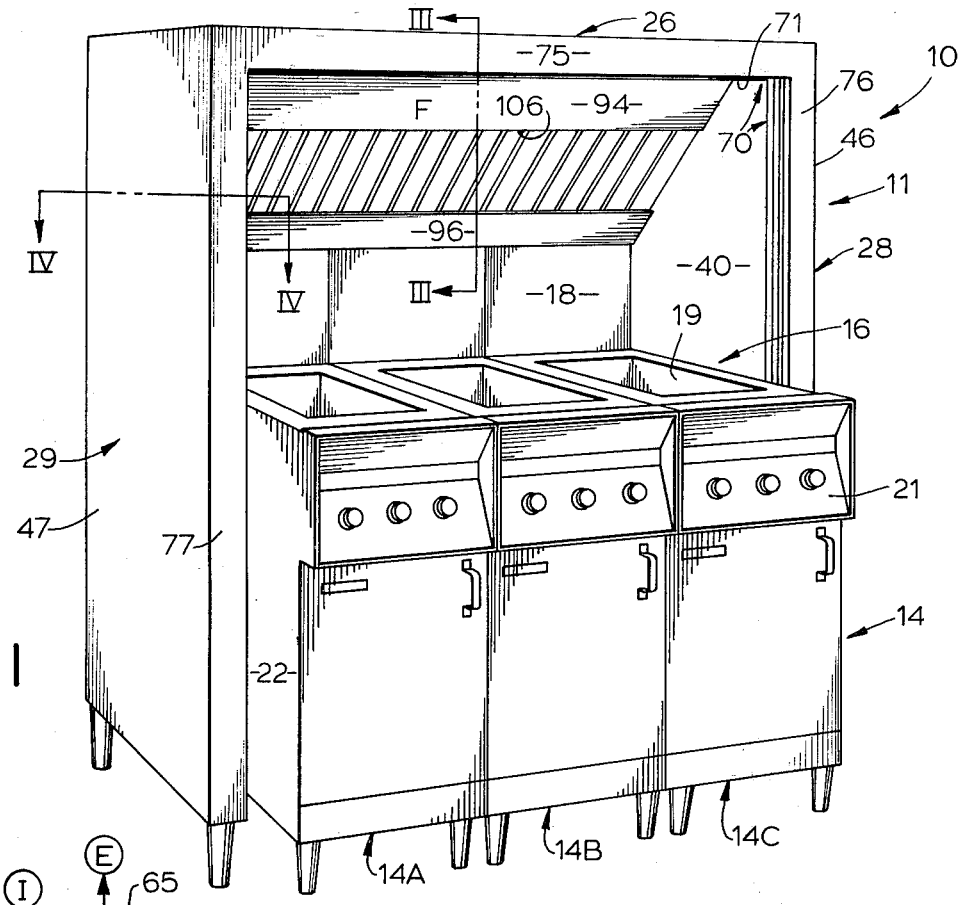
FIG. 1 is a pictorial view, substantially taken from the front, of a ventilator embodying the invention and placed in operative position with respect to three cooking units of the deep fat fryer type.

Certain terminology will be used in the following description for convenience in reference only and will not be limiting. The words "up", "down", "right" and "left" will designate directions in the drawings to which reference is made. The words "front" and "rear" will refer to, respectively, the portions of the apparatus shown to the left and right in FIG. 2. The words "in" and "out" will refer to directions toward and away from, respectively, the geometric center of the device and designated parts thereof. Such terminology will include derivatives and words of similar import.

SUMMARY OF THE INVENTION

The objects and purposes of the invention are met by providing a ventilator for cooking units particularly of the kind having a forwardly disposed cooking area and a rearwardly disposed, upstanding flue, as for exhausing of combustion products. The ventilator comprises a free-standing floor-supported hood of rectangular box shape and opens forward and downward to receive the cooking unit removably therein. The hood is formed by box-like inner and outer shells opening forwardly and downwardly with their top, back and opposite side panels spaced to define a single continuous air flow space there between. The air flow space is closed except for an inlet adjacent the rear of the hood and an outlet comprising an inverted U-shaped slot disposed near and extending along the front edges of the top and side panels of the inner shell to face into the cooking area and having a pair of flow directing louvers extending therealong. A U-shaped perforated baffle between the shells separates the front and rear parts of the air space. An exhaust stack communicates with the upper rear portion of the inner shell. A substantially J-shaped member extending the width of the inner shell below the exhaust stack on the one hand supports filters facing down and forward toward the cooking area for removing cooking fumes therefrom, and on the other hand, is spaced by a downwardly flaring bypass or slot from the rear panel of the inner shell to deflect exhaust flow from the cooking unit flue, positioned immediately therebeneath, to the exhaust stack without going through the filter.

DETAILED DESCRIPTION

Figure 2:
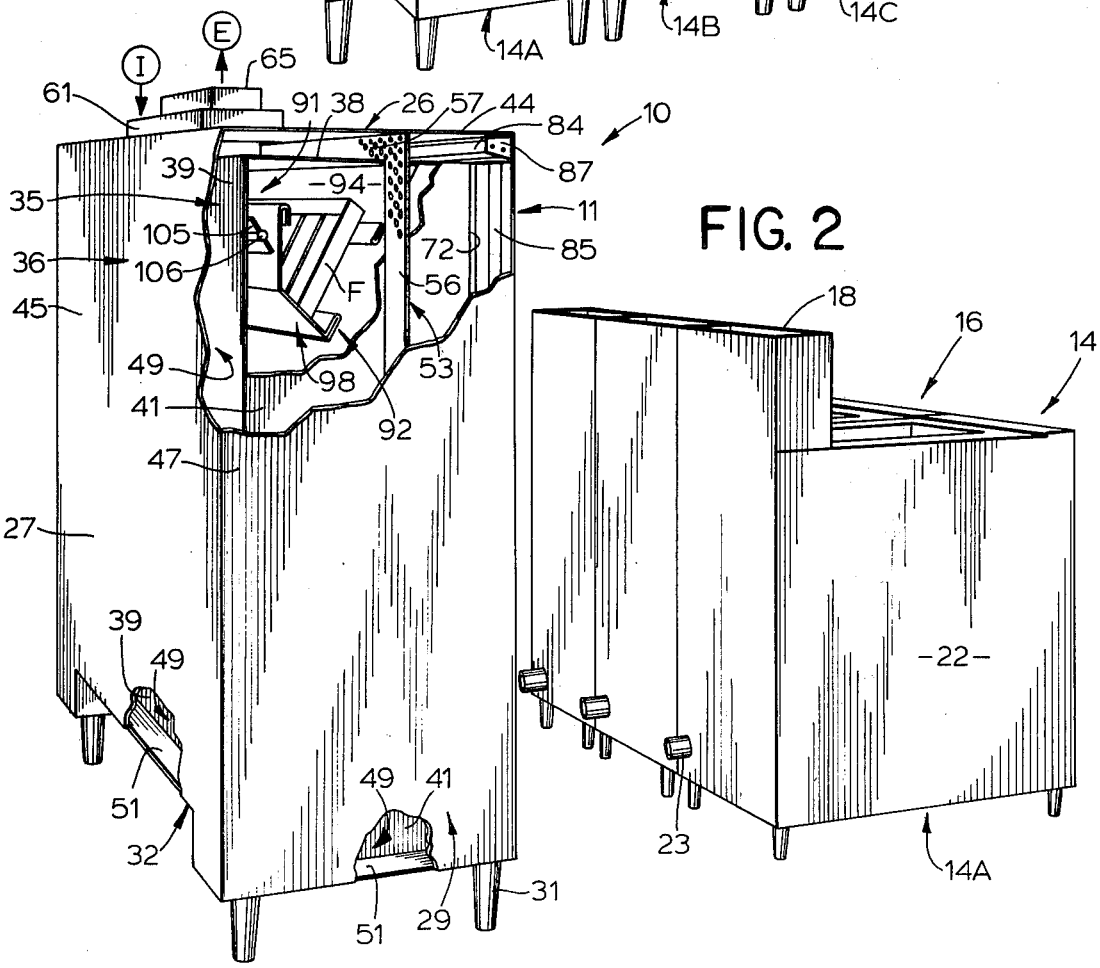
FIG. 2 is a partially broken pictorial view of the FIG. 1 apparatus taken substantially from the left, rearward quarter thereof.

A ventilating system 10, embodying the invention, comprises a floor-supported hood 11 shown in FIG. 2 prior to installation with respect to a plurality of cooking units 14, shown by way of example only, with which it may be used. The hood 11 is shown in FIG. 1 installed with respect to such cooking units 14.

The cooking units 14 here used by way of example only are three fuel fired deep fat fryers 14A, 14B and 14C. The cooking units are floor-supported independently of the hood 11 and normally are not connected thereto. The cooking units 14 each have a forwardly disposed, upwardly facing cooking zone 16 occupying the major portion of the fore-aft length of the cooking unit, and a rearwardly disposed flue 18 behind and upstanding from the cooking zone 16. Where, as in the present example, the cooking units are deep fat fryers, the cooking zone 16 takes the form of upwardly opening deep fat wells 19. In the particular embodiment shown, the flues vent a burner area (not shown) below the deep fat wells 19 to carry combustion products therefrom. Typically, such cooking units have front-mounted controls 21, enclosing cabinet walls, as exemplified by side walls 22 and energy input means, here exemplified by fuel pipes 23 mounted low on the rear side of each cooking unit 14.

The ventilating apparatus 10 may be used with other kinds of cooking units, for example grills or other commercial units, with or without the upstanding, boxlike flues 18.

Turning now to the ventilating apparatus 10, the hood 11 is of rectangular boxlike form, open at the front and bottom, and has substantially planar top, back and side walls 26, 27, 28 and 29. The hood 11 is normally sized to receive the desired number and type of cooking units 14 with their flues 18, if provided, snugly between side walls 28 and 29 thereof. Though the hood 11 of the present invention provides fresh air as well as exhausting gaseous cooking and combustion products, it is preferably less thick front to rear than the cooking units 14, such that the latter stick out forwardly in front of hood 11. In one instance, a 22" thick hood 11 was used in connection with cooking units about 29½" deep.

Preferably the hood 11 is elevated above the floor on legs 31 of sufficient height as to permit cleaning thereunder (e.g. 6" high). To clear the rearwardly extending feed pipes 23 of the cooking units 14, the lower edge of the hood back 27 is elevated somewhat, as at 32 (FIG. 2).

The hood 11 comprises an inner shell 35 and an outer shell 36, each of rectangular, substantially boxlike form. The inner shell 35 comprises planar, substantially rectangular top, back and side panels 38, 39, 40 and 41 joined along their adjacent edges, leaving the front and bottom of the inner shell open.

The outer shell 36 comprises substantially planar, rectangular top, back and side panels 44, 45, 46 and 47 which are spaced outward from the corresponding top, back and side panels of the inner shell 35 by a continuous substantially uniform thickness air space 49. Thus, the top, back and side walls 26–29 are hollow and intercommunicating.

The bottoms of the back and side walls of the inner and outer shells 35 and 36 are interconnected by a bottom strip wall 51 (FIG. 2) which closes the bottom of the air space 49, rigidly interconnects the bottom portions of the shells 35 and 36, and provides an attachment surface for the legs 31.

A perforated metal pressure plate 53, substantially of U-shape, separates the front portion of the air space 49 from the rear portion thereof. The perforations in the pressure plate 53 permit air flow from the rear of the air space 49 to the front thereof but with a sufficient pressure drop across the pressure plate 53 as to make the rate of air flow forwardly therepast substantially uniform along the top and sides of the hood. More particularly, the U-shaped pressure plate 53 has upstanding side legs, one of which is shown in FIG. 2 at 56, and a top bight 57, all perforated with a substantially uniform array of air holes. The U-shaped perforated pressure plate 53 is located at about ½ the distance between the front and rear of the hood 11. The edges of the U-shaped plate 53 are respectively secured to the opposed faces of the top panels 38, 44 and side panels 40, 46 and 41, 47 of the inner and outer shells 35, 36, as well as to the bottom strip wall 51, by any convenient means not shown, such as welding, or bolted or riveted securement through flanges or brackets not shown. In this way, the U-shaped perforated plate not only serves to control air flow through the air space 49, but also assists in rigidly interfixing and spacing the inner and outer shells 35, 36, particularly at their top and sides.

A fresh air inlet stack 61 (FIGS. 2 and 3) extends, here upwardly, from the end portion of the hood 11 to a suitable fresh air source schematically indicated at I. The fresh air source may conveniently be a conventional motor-driven blower, typically arranged to pull outside air into the stack 61. The stack 61 communicates through an opening 62 in the outer shell 35, here centered along the rear edge of the top panel 44 thereof, so as to flow fresh air from the source I through the opening 62 and into the rear portion of the air space 49, i.e., into the hollow hood back wall 27 and the portions of the hollow hood top and side walls 26, 28 and 29, behind the U-shaped perforated plate 53.

An exhaust stack 65 communicates with the interior of the inner shell 35, at the upper rear portion thereof, preferably at a central location along the rear of the top panel 38 at an opening 66 therein. Conveniently, the exhaust stack 65 extends loosely and coaxially within the inlet stack 61. The exhaust stack 65 is connected to an exhaust blower E for exhausting air and gases from inside the hood 11. In a typical installation, the exhaust blower E exhausts to the atmosphere outside the building, and indeed may be located outside the building.

An inverted U-shaped air slot 70 adjacent the front edge of the hood 11 communicates with the forward portion of the air space 49 between the inner and outer shells and opens toward the cooking units 14 within the hood 11. More particularly, the U-shaped air slot 70 includes upstanding opposed facing slot legs at the forward edges 72 of the inner shell side panels 40 and 41, and a slot bight extending between the upper ends of the slot legs and located at the front edge 71 of the inner shell top panel 38. The top and side panels 44, 46 and 47 of the outer shell 36 extend forward beyond the front edges 71 and 72 of the top and side panels of the inner shell 35 and have inturned end plate portions 75, 76 and 77, respectively, which portions face forwardly to close the forward edges of the air space 49 between the inner and outer shells 35 and 36. Flanges 79 extend rearwardly from the inner edges of the inturned portions 75–77, toward and in coplanar relation with the front edges 71 and 72 of the top and side walls of the inner shell 35 so as to define the downward and laterally inward facing portions of the air slot 70. In the particular embodiment shown, the flanges 79 and portions 75–77, while defining the air slot 70, also assist in rigidifying the outer shell of the hood. The flange 79 and portions 75–77 define a shallow air deflection groove 81 at the front edge of the hood 11.

Figure 3:
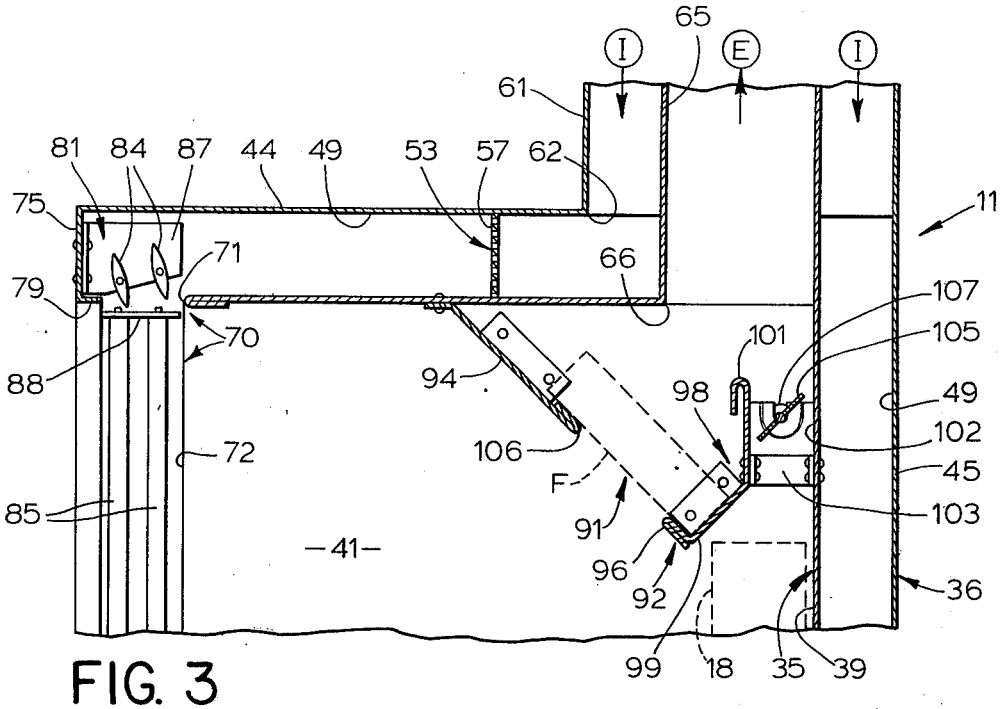
FIG. 3 is an enlarged, fragmentary sectional view substantially taken on the line III—III of FIG. 1.
Figure 4:
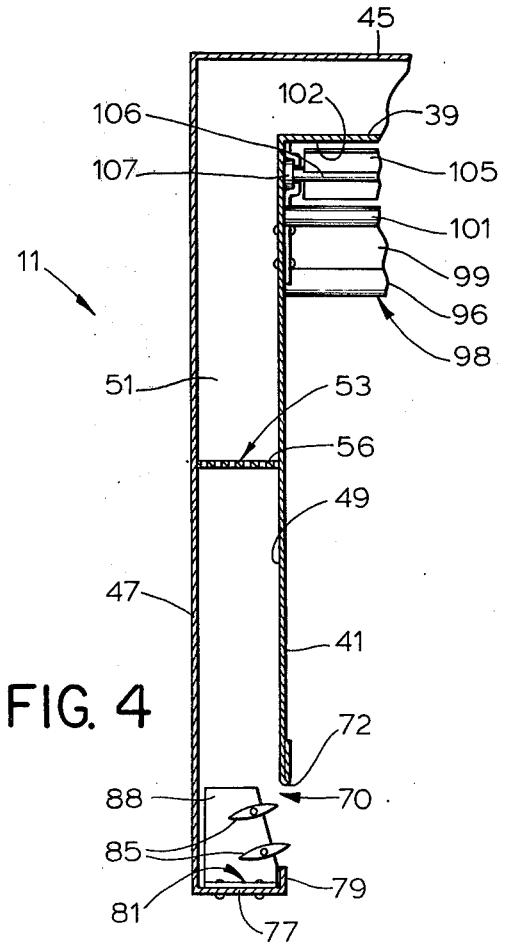
FIG. 4 is an enlarged, fragmentary, cross sectional view substantially taken on the line IV—IV of FIG. 1.

To assist in directing fresh air flow, from its forward path along the forward portion of the air space 49, out of the air slot 70 and in somewhat rearwardly angled relation inward toward the cooking zones 16 of the cooking units 14, a pair of substantially parallel top louvers 84 are disposed in the forward portion of the air space 49 at the top bight portion of the air slot 70. Similarly, further pairs of parallel louvers 85 are disposed in the forward portion of the air space 49 at the side legs of the air slot 70. The louvers in such pairs 84, 85, extend parallel to and in spaced relation from each other and the corresponding panel edges 71, 72 and flange 79 defining the corresponding bight and side legs of the air slot 70. In the preferred embodiment shown, the louvers 84 extend the entire width of the upper, bight portion of air slot 70 and are supported at their ends on generally L-shaped brackets, one of which is shown at 87, here attached, as by bolts or rivets, to the opposed surface of the outer shell 36. Similarly, the side louvers 85 are preferably end-supported by brackets 88 secured to the outer shell 36 by any convenient means. The brackets 87 and 88 preferably adjustably pivotally support the louvers 84, 85 on their length axes, with such louvers somewhat inclined rearwardly as they extend inwardly and with the forward one of such louvers of each pair extending more than the rearwardmost louver into the inner slot 70, as shown in FIGS. 3 and 4. The louvers 84 and 85 of each louver pair are preferably of the elongate substantially oval cross section shown in FIGS. 3 and 4.

Where, as in the embodiment shown, the hood 11 is intended to fit snugly, in terms of width, over cooking units 14 having covered side walls 22, the latter tend to block the opposed lower portion of the side legs of the air slot 70 such that the significant portion of the fresh air flow takes place at or above the cooking zone 16 of the cooking units 14. Accordingly, in this instance, the side legs of the air slot 70, and if desired the side louvers 85, may continue downward past the cook tops 16 to a point at or adjacent the bottom strip wall 51 of the hood 11. In some instances however, as when the width of the cooking unit 16 may be substantially less than the interior width of the hood 11, it is contemplated that the side legs of the air slots 70, as well as the side louvers 85 may extend downwardly only to about the height of the front portion 16 of the cooking units 14, when desired to limit air flow from the slots 70 substantially to the cooking zone 16.

An exhaust collection chamber 91 occupies a wedge-shaped space in the upper rear portion of the inner shell 35. The exhaust collection chamber preferably extends the width of the inner shell 35 and is bounded by the adjacent portions of the top and back panels 38 and 39 thereof. The forward, lower portion of the exhaust collection chamber 91 is defined by a filter support structure generally indicated at 92. The filter support structure 92 includes a fixed first plate 94 preferably secured to the top and side panels of the inner shell 35 in spaced relation ahead of the exhaust stack 65 and intermediate the top wall 38. The first plate 94 is angled to face downward and forward. A flangelike second plate 96 is substantially coplanar with the first plate 94 but is spaced downward and rearward therefrom, in the present embodiment at a location beneath the exhaust stack 65 but forwardly spaced from the rear wall 39 of the inner shell 35. In the preferred embodiment shown, the second plate 96 is part of a substantially J-cross section bypass member 98 which further comprises a third portion or plate 99 which supports and angles upward and rearward from the rear edge of the second flangelike plate 96. The bypass member 98 further includes a bypass wall 101 fixed to and upstanding from the top of the third plate 99 and spaced forward from the rear wall 39 of the inner shell by a bypass generally indicated at 102. The J-shaped member 98 extends between and preferably is fixedly mounted on the side panels 40, 41 of the inner shell 35. If desired, one or more brackets 103 may be spaced along the lateral extent of the bypass opening to rigidify the laterally intermediate portion of the J-shaped member 98 and rear wall 39.

The opposed edges of the first and second plates 94 and 96 are transversely spaced by a filter opening 106 preferably extending the width of the inner shell. Normally, substantially rectangular filters F are supported on the adjacent, upwardly and rearwardly facing surfaces of the plates 94 and 96, the lower edges of such filters F resting against the third plate 99, such that the filters face, at an angle, downwardly and forwardly toward the cooking zone 16. The filter F may conveniently comprise a plurality of individual filter units placed side by side to cover the filter opening 106 for its entire length, as seen in FIG. 1, for filtering of cooking vapors drawn from the cooking zone 16 therethrough by flow to the exhaust stack 65. The filters F are easily removed, as for cleaning, by moving same upwardly along the first plate 94 until free of the flangelike second plate 96 whereupon the lower edge of the filter may be pivoted forwardly and pulled downwardly through the filter opening 106.

As above mentioned, the ventilator embodiment here disclosed is particularly advantageous for use with cooking units having a rearwardly disposed, upstanding flue 18 from which flow gaseous combustion products or the like. The height of the J-shaped member 98 is set such that the lower edge of flange 96 just clears the upper edge of cooking unit flue 18, permitting the cooking unit to be moved rearwardly into the hood (or vice versa) such that the flue 18 lies beneath the bypass opening 102. Accordingly, whereas cooking vapors released from the front portion 16 of the cooking unit 14 tend to be drawn upward through the filter F, vapors released from the flue 18 tend to be captured by the slope of third plate 99 and deflected upward through the bypass opening 102 to the exhaust stack 65. Preferably, an openable or closable damper or vane 105 is positioned in the bypass opening 102 and extends the lateral width thereof. Conveniently, such vane is provided with central, end-extending shafts 106 (FIG. 4) which may be pivotally supported, by any convenient means, such as suitable bracket members 107 on the side walls 40, 41 of the inner shell 35. The damper 106 may be adjusted by suitable automatic or manually actuable means not shown, either at initial set up or during on-going operation. A particularly simple approach is to manually preset the pivotal position of the damper 105, against the frictional holding force of the bearings 107, at such position as to segregate the cooking vapors from cook top 16 from gases exiting the flue 18 of the cooking unit, such that they pass to the exhaust flue through the filter F and bypass opening 102, respectively.

To briefly summarize aspects of installation and operation of the invention, the hood 11, which is normally constructed of sheet metal, requires for its installation a simple interconnection of the stacks 61 and 65 to the pressurized inlet air source I and exhaust blower unit E, which may be located as convenient, normally outside the building containing the cooking units 14. The hood 11, supported on the existing floor of the kitchen, receives the cooking units 14 therein as shown in FIG. 1.

In use, the hood 11 operates to rid the kitchen area, and particularly the area in the immediate vicinity of the cooking units 14, of cooking vapors and other fumes generated by the latter. More particularly, with both the intake and exhaust blowers I and E operating, fresh air is forced by blower I into intake stack 61 and thence into the top, back and sides of the hollow air space within the hood 11. By reason of the pressure drop across the inverted U-shaped, perforate plate 53, separating the front portion of the hood from the rear portion thereof, the fresh air flow rate to the air slot 70 is substantially the same all along the top and sides of such slot. The top and side louver pairs 84, 85 direct this uniform fresh air flow, in a carefully controlled manner, substantially parallel to the front plane of the hood but angled slightly rearward therefrom, and into the area immediately above the cooking zone 16 of the cooking units 14. At the same time, the operation of the exhaust blower E tends to pull air, with cooking vapors generated in zone 16 by the cooking units 14, rearward and upward through the filters F and thence out through the exhaust stack E. Thus, the pressurized inlet air emerging in substantially curtainlike form from the air slots 70 entrains cooking vapors from the cooking areas 16 of cooking units 14 and then is drawn out through the filter F and exhaust stack 65 by the exhaust blower E. Accordingly, the air from slot 70 in effect sweeps the atmosphere above the cooking zone 16 out through the filter on a continuous basis.

At the same time, fumes generated by the lower portions of the cooking units, as by combustion of a fuel to generate the necessary heat for cooking, are drawn out of the flue 18 of each cooking unit through the bypass opening 102 and thence into the exhaust stack 65 by exhaust blower E. By appropriate adjustment of the opening of the damper 105, and by reason of the relatively close fit of the flue 18 beneath the inverted funnellike portion 99, 101 of member 98, gases from the flue 18 tend to pass only up through bypass 102 rather than escaping forwardly to pass through the filter. Such assists in avoiding any possibility of ignition of grease, or the like, trapped in a filter F by hot gases escaping from the flue, as where the flue is used to exhaust combustion products from a burner of the cooking unit 14 and wherein the filter F has not been cleaned after a long period of use, as above a deep fat fryer. On the other hand, proper adjustment of the damper 105 tends to prevent bypassing of cooking vapors around the filters F, by limiting the flow through the bypass passage substantially to that required to exhaust the flue 18.

In early testing with a hood having an outside length of about 5 feet and outside height of about 5 feet, used with a three unit deep fryer as the cooking units 14 with an exhaust flow rate of about 650 cfm, variation of inlet air flow rate from about 650 cfm to almost 1000 cfm appeared to capture vapor in the cooking zone quite completely, with the louvers at the side of the unit set at about 90° and the louvers at the top of the unit set at about 30° from perpendicular for maximum freedom from leakage of vapor from the cooking zone. On the same unit, temperature readings with the three fryers at full fire and with 650 cfm exhaust and air supply flow rates, exhaust temperature at a point three feet above the hood 11 read 190° F., exhaust temperature at the exhaust fan E (in this instance on the roof of the building) read 166° F., outside air temperature was 77° F., supply air temperature before reaching the hood 11 was 82° F. and supply air temperature at the air slot was read at 100° F.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A ventilator for use with cooking units, including grills, deep fat fryers, and the like, comprising:

a free-standing, floor-supported hood of rectangular box shape closed at its top, back and sides and having open front and bottom faces for reception thereinto of a cooking unit or units;

said hood including a substantially rectangular boxlike inner shell having top, back and opposite side panels and being open at the front and bottom faces thereof, said hood further having a substantially rectangular boxlike outside shell fitted closely over said inside shell and having top, back and opposed side panels uniformly and closely spaced from the corresponding ones of the top, back and opposed side panels of the inner shell and therewith defining a single, continuous air flow space extending between the opposed surfaces of the inner and outer shells;

the front edges of the top and side panels of said outer shell having flanges in the frontal plane of said outer shell and extending across the front of the space between the inner and outer shell panel, said top and side panels of said inner shell having front edges spaced behind said flanges and therewith defining an inverted U-shaped slot opening inward of said hood along the front face thereof from the front edge portions of the air flow space at the top and sides of said hood;

a generally U-shape bottom strip interconnecting the lower edges of the inner and outer shells along the bottom of the side and back panels thereof for closing the bottom of said air flow space;

a perforated sheet bulkhead, U-shaped in elevation, having a top central portion spanning the space between the top panels of the inner and outer shells and further having a pair of depending leg portions each spanning the space between adjacent side walls of the inner and outer shells so as to physically isolate the front portions of the top and sides of the hood from the remaining portions of the top and sides of the hood and the back of the hood except by access through the perforations in said bulkhead;

an exhaust stack extending from the top wall of said inner shell behind said bulkhead upward through an opening in the top wall of said outer shell and air moving means associated with said exhaust stack for pulling exhaust gases from within said inner shell out through said exhaust stack;

an inlet air stack communicating through the top wall of said outer shell with the air flow space between such shells in the region behind said perforated bulkhead, said inlet stack loosely coaxially surrounding said exhaust stack;

a pair of louvers spaced from each other and extending along the top part of said slot and the upper portions of the side parts of said slot, substantially in the area at and above the height of the cooking surface of said cooking unit, wherein said louvers direct air toward the cooking location on said cooking unit so as to assist exhausting of smoke and other vapors released during cooking rearward and upward through said exhaust stack.

2. The apparatus of claim 1, including a first, upper filter support plate extending between the side panels of said inner shell and angled downwardly and rearwardly from the top panel of said inner shell in spaced relation between said exhaust stack and the air outlet slot, a second support plate extending between the side panels of said inner shell substantially in coplanar relation with said first plate and spaced rearwardly and downwardly therefrom, said second plate being an extension of a third platelike member angled downward and forward away from the rear panel of said inner shell and which extends full width between the side panels of said inner shell, the coplanar upper surfaces of said first and second support plates facing the rear and upper panels of said inner shell and therewith containing an exhaust collection chamber open to said exhaust stack, said upper faces of said first and second plates being adapted to support a substantially flat filter means covering the space between said first and second plates for filtering exhaust gas flow entering said exhaust collection chamber therebetween.

3. The apparatus of claim 2, in which said third plate is spaced ahead of said rear panel of said inner shell by an exhaust bypass opening extending the width of said inner shell for permitting exhaust flow upward into said exhaust collection chamber and exhaust stack other than through the filter opening defined between said first and second plates, and a damper member extending the length of said bypass opening and disposed substantially between said third plate and the rear panel of said inner shell and movable for selectively increasing and reducing the effective cross sectional area of said bypass opening and thereby control exhaust flow therethrough.

4. The apparatus of claim 1, including substantially platelike brackets disposed in pairs at opposite ends of the pairs of louvers for pivotally adjustably supporting each louver pair, and including flanges for fixedly securing the brackets to walls of the outer shell.

5. A ventilator for use with cooking units and the like, of the kind having a forwardly disposed, upwardly facing cooking zone and a rearwardly disposed upwardly opening fume outlet stack extending upward above said cooking zone, said ventilator comprising:

a free-standing, floor-supported hood of rectangular box shape closed at its top, back and sides, and open at its front and bottom for reception thereinto of at least one said cooking unit;

said hood including a substantially rectangular boxlike inner shell having top, back and opposite side panels and being open at the front and bottom, said hood further having a substantially rectangular boxlike outer shell fitted closely but in spaced relation over said inner shell and having top, back and opposed side panels uniformly and closely spaced from the corresponding ones of the top, back and opposed side panels of said inner shell and therewith defining a single, continuous airflow space extending between the opposed surfaces of said inner and outer shells;

flanges extending in the frontal plane of said outer shell form the top and side panels thereof across said space between said inner and outer shells and having inner edges spaced ahead of the forward edges of the top and side panels of said inner shell so as to define an inverted U-shaped slot opening inward of said hood along the front thereof, the upper and side reaches of said U-shaped slot facing toward an intermediate portion of the cooking zone for receiving gases received in the cooking zone of a cooking unit;

means in said upper and side portions of said U-shaped slot above the height of the cooking zone of the cooking unit for directing air flow toward said cooking zone from said air flow space between said inner and outer shells;

a generally U-shaped bottom strip interconnecting the lower edges of said inner and outer shells to close the bottom of said air flow space;

an exhaust stack communicating through and extending upward from the upper rear portion of said inner shell, and air moving means associated with said exhaust stack for pulling exhaust gases from within said inner shell out through said exhaust stack;

a fresh air inlet stack communicating through the wall of said outer shell with the air flow space between said shells, said air inlet stack being remotely spaced from said U-shaped slot;

substantially coplanar first and second support plates extending widthwide across said inner shell, said first plate extending from the upper panel of said inner shell in angled relation downward and rearward toward but well spaced from the rear panel of said inner shell, said second plate being disposed in spaced relation between said first plate and said inner shell rear panel and being spaced from said first plate to define therebetween an exhaust filter slot closable by platelike filters supported on the faces of said first and second plates and extending the width of said inner shell, the upper, rear portion of said inner shell, substantially bounded by said first and second plates, intervening filter slot, and upper and rear inner shell panels constituting an exhaust collection chamber directly communicating with said exhaust stack;

a third plate affixed to the rear portion of said second plate and extending upward therefrom partway to the top panel of said inner shell, in forward spaced relation from said rear panel of said inner shell and extending the width of said inner shell for defining a filter bypass opening from the rearward portion of the space within said inner shell into said exhaust collection chamber, said bypass being located to snugly overlie the open upper end of the fume outlet stack of the cooking unit and said third plate being oriented to divert fumes emergent from said fume outlet stack upward through said bypass and to said exhaust stack without need to pass through said filter.

6. The apparatus of claim 5, including an adjustable damper member extending the width of said bypass and movably mounted with respect to said inner shell for varying the effective cross-sectional area of said bypass and thereby controlling the rate at which fumes are drawn from said cooking unit stack into said exhaust collection chamber.

* * * * *